US005992605A

United States Patent [19]

Haruta

[11] Patent Number: 5,992,605

[45] Date of Patent: Nov. 30, 1999

[54] ESCALATOR SYSTEM WITH WHEEL CHAIR STEPS AND AN OPERATING METHOD THEREFOR

[75] Inventor: Yasumasa Haruta, Tokyo, Japan

[73] Assignee: Mitsubishi Denki Kabushiki Kaisha, Tokyo, Japan

[21] Appl. No.: 08/897,611

[22] Filed: Jul. 21, 1997

[30] Foreign Application Priority Data

Nov. 5, 1996 [JP] Japan ..... 8-292608

[51] Int. Cl.[6] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 4,681,207 | 7/1987 | Goto et al. | 198/333 |
| 5,024,314 | 6/1991 | Kitamura et al. | 198/333 |
| 5,062,519 | 11/1991 | Haruta | 190/333 |

FOREIGN PATENT DOCUMENTS

| | | |
|---|---|---|
| 64-87490 | 3/1989 | Japan . |
| 214278 | 4/1990 | Japan . |
| 6-092581 | 4/1994 | Japan . |

*Primary Examiner*—Joseph E. Valenza
*Attorney, Agent, or Firm*—Leydig, Voit & Mayer, Ltd.

[57] ABSTRACT

An escalator system with wheel chair steps comprising a main frame having an upper end and a lower end, a plurality of steps connected in an endless conveyor loop and capable of circulating along the main frame, and an operating mechanism disposed at a position close to the ends of the main frame. The escalator system further comprises a first wheel chair step disposed between the steps and having a connection arm capable of being displaced toward the lower end of the main frame by a shifter mechanism engageable with the operating mechanism when necessary. The escalator system also comprises a second wheel chair step disposed between the steps and having a rising tread board capable of being raised by a raising mechanism engageable with the operating mechanisms when necessary and a boarding plate capable of being displaced toward the lower end of the main frame by a shifter mechanism engageable with the operating mechanism when necessary. The rising tread board, when raised, is supported by the connection arm displaced in a projected position and defines a combined and enlarged horizontal surface together with the tread board of the first wheel chair step.

14 Claims, 14 Drawing Sheets

ESCALATOR SYSTEM WITH WHEEL CHAIR STEPS AND AN OPERATING METHOD THEREFOR

BACKGROUND OF THE INVENTION

This invention relates to an escalator system with wheel chair steps and an operating method therefor and, more particularly, to an escalator system and an operating method therefor in which wheel chair steps are connected in an endless conveyor loop of steps for providing an enlarged tread surface for a wheel chair when in need.

In a conventional escalator with wheel chair steps disclosed in Japanese Patent Publication No. 2-14278, the arrangement is such that at least three steps stop in the upper or lower horizontal run and provide a combined and enlarged horizontal surface so that a wheel chair can ride on or off the enlarged horizontal surface.

In the conventional wheel chair escalator as above discussed, at least three steps are horizontally positioned at the upper or lower horizontal run in order to allow a wheel chair to ride on or off. Therefore, the overall length of the escalator main frame becomes long and the provision of the installation space is difficult, whereby a limitation is posed on the installation of the escalator system with wheel chair steps. Also, a main frame of an already installed escalator without wheel chair steps cannot be used without modifications, so that additional modification is work is necessary.

SUMMARY OF THE INVENTION

Accordingly, an object of the present invention is to provide an escalator system with wheel chair steps free from the above discussed problems of the conventional design.

Another object of the present invention is to provide an escalator system with wheel chair steps which can convey a wheel chair on a combined, enlarged tread of the wheel chair steps mounted on a main frame of an ordinary type.

A further object of the present invention is to provide a method for operating an escalator system with wheel chair steps in which a wheel chair can be conveyed on a combined, enlarged tread of the wheel chair steps mounted on a main frame of an ordinary type.

With the above objects in view, the present invention resides in an escalator system with wheel chair steps comprising: a main frame having an upper end and a lower end, a plurality of steps connected in an endless conveyor loop and capable of circulating along the main frame, and an operating mechanism disposed at a position close to the ends of the main frame. The escalator system further comprises a first wheel chair step disposed between the steps and having a connection arm capable of being displaced toward the lower end of the main frame by a shifter mechanism engageable with the operating mechanism when necessary. The escalator system also comprises a second wheel chair step disposed between the steps and having a rising tread board capable of being raised by a raising mechanism engageable with the operating mechanisms when necessary and a boarding plate capable of being displaced toward the lower end of the main frame by a shifter mechanism engageable with the operating mechanism when necessary. The rising tread board, when raised, is supported by the connection arm displaced in a projected position and defining a combined and enlarged horizontal surface together with the tread board of the first wheel chair step.

According to the escalator system with wheel chair steps as described above, when the first wheel chair step is travelling in an initial stage of a transitional travel path and provides a difference in elevation relative to the second wheel chair step travelling in a horizontal travel path, the rising tread board raised by the raising mechanism is supported by a support arm at a location at which an enlarged horizontal tread surface is defined by the tread boards of the first and second wheel chair steps.

According to the escalator system with wheel chair steps as described above, when the first wheel chair step is travelling in an initial stage of a transitional travel path and provides a difference in elevation relative to the second wheel chair step travelling in a horizontal travel path and the endless conveyor loop is in the stopped state, the rising tread board raised by the raising mechanism is supported by a support arm at a location in which an enlarged horizontal surface continuous to the tread board of the first wheel chair step is defined, and wherein the first wheel chair step and the second wheel chair step travel along a constant slope travel path with their tread boards maintained in the position defining the enlarged horizontal surface.

A method for operating an escalator system with wheel chair steps having a main frame having an upper end and a lower end and a plurality of steps connected in an endless conveyor loop for circulating along the main frame comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position on the lower end side of the main frame and the first wheel chair step positions higher than the second wheel chair step. The boarding plate extends from the second wheel chair step having the raised rising tread board toward the lower end side of the main frame.

Another method of the present invention for operating an escalator system with wheel chair steps that has a main frame having an upper end and a lower end and a plurality of steps connected in an endless conveyor loop for circulating along the main frame comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position at an end of the main frame and the first wheel chair is positioned higher than the second wheel chair step, and connecting the first wheel chair step to the second wheel chair step having the raised rising tread board with a connection arm of the first wheel chair step.

According to another method of the present invention for operating an escalator system with wheel chair steps with a main frame having an upper end and a lower end and a plurality of steps connected in an endless conveyor loop for circulating along the main frame comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position at an end of the main frame and the first wheel chair step is positioned higher than the second wheel chair step, and moving the first wheel chair step and the second wheel chair step along a constant slope travel path with their tread boards maintained in the position defining the enlarged horizontal surface.

A method for operating an escalator system with wheel chair steps may further comprise extending the boarding plate to a position projected from the second wheel chair step for allowing a wheel chair user to board onto the steps, retracting the boarding plate, and extending a wheel stopper on the second wheel chair step to a position projected from a lower end side of the main frame of a tread of the second wheel chair step.

A method for operating an escalator system with wheel chair steps may additionally comprise moving a tilting tread board of a tilting wheel chair step to a tilted position upon conveying a wheel chair with the tilted step connected between the steps in the endless conveyor loop and disposed adjacent to the first wheel chair step and on an upper end side of the main frame.

A method for operating an escalator system with wheel chair steps may include stopping the first wheel chair step and the second wheel chair step at a predetermined position at the end portion of the main frame, and operating an operating mechanism in a rising mode to raise the rising tread board of the second wheel chair step.

A method for operating an escalator system with wheel chair steps may also include stopping the first wheel chair step and the second wheel chair step at a predetermined position at the end portion of the main frame, and operating an operating mechanism in driving mode to raise the rising tread board of the second wheel chair step.

A method for operating an escalator system with wheel chair steps may additionally include stopping the first wheel chair step and the second wheel chair step at a predetermined position at the end portion of the main frame, and operating an operating mechanism into engagement with the rising tread board of the second wheel chair step.

A method for operating an escalator system with wheel chair steps may further comprise moving the tilting tread board of the tilting wheel chair step to a tilted position when the first and the second wheel chair steps are stopped at a predetermined position at the upper end portion of the main frame.

A method for operating an escalator system with wheel chair steps may also comprise moving the tilting wheel chair step to a position below the comb plate of the upper end potion of the main frame when the first and the second wheel chair steps are stopped at a predetermined position at the upper end portion of the main frame.

In a method for operating an escalator system with wheel chair steps, the amount of raised displacement of the rising tread board, at the lower horizontal run of the main frame when the rising tread board of the second wheel chair step is raised to define the enlarged horizontal surface together with the first wheel chair step, may be different from an amount of the raised displacement of the rising tread board at the upper horizontal run.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
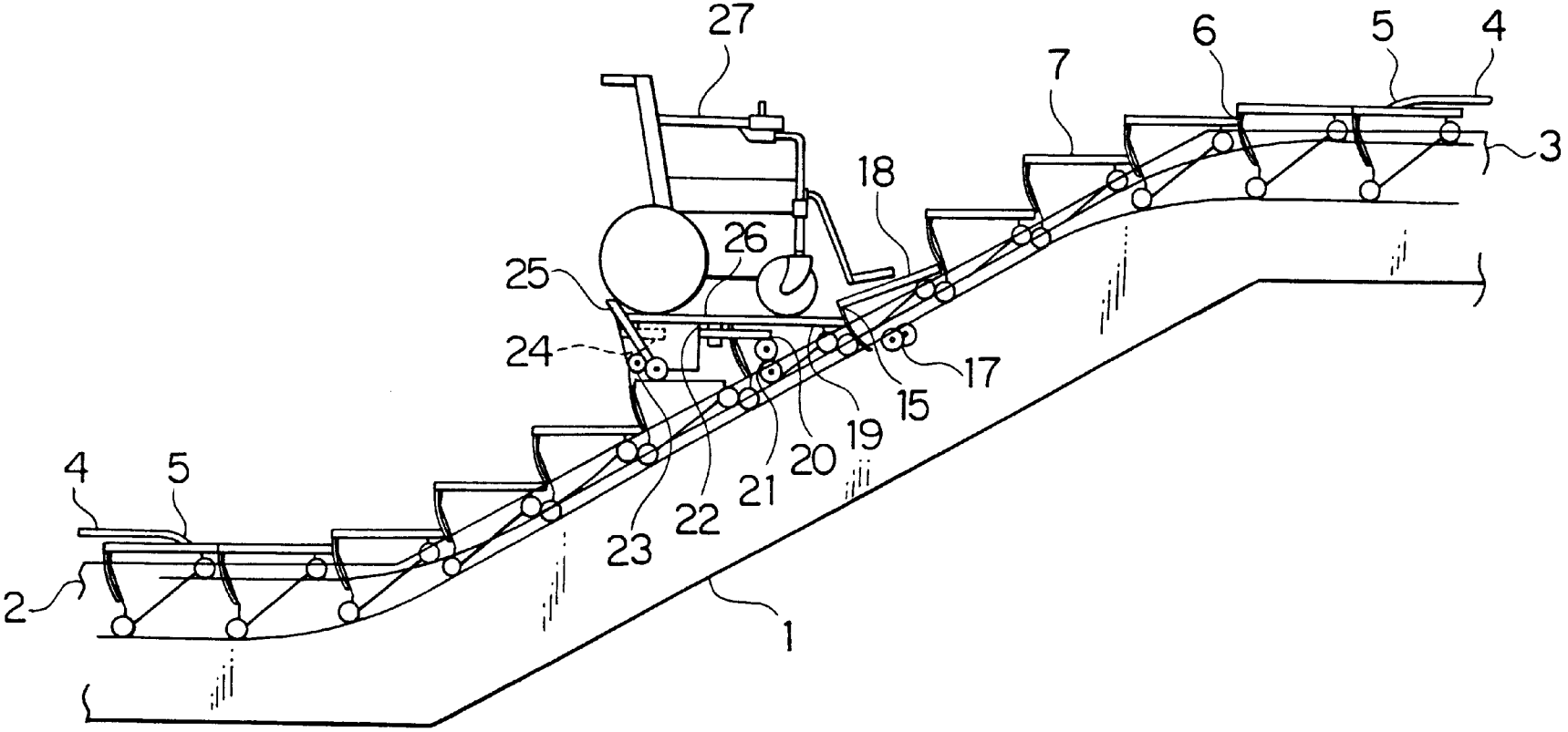
FIG. 1 is a schematic side view of an escalator system with wheel chair steps of one embodiment of the present invention.
Figure 2:
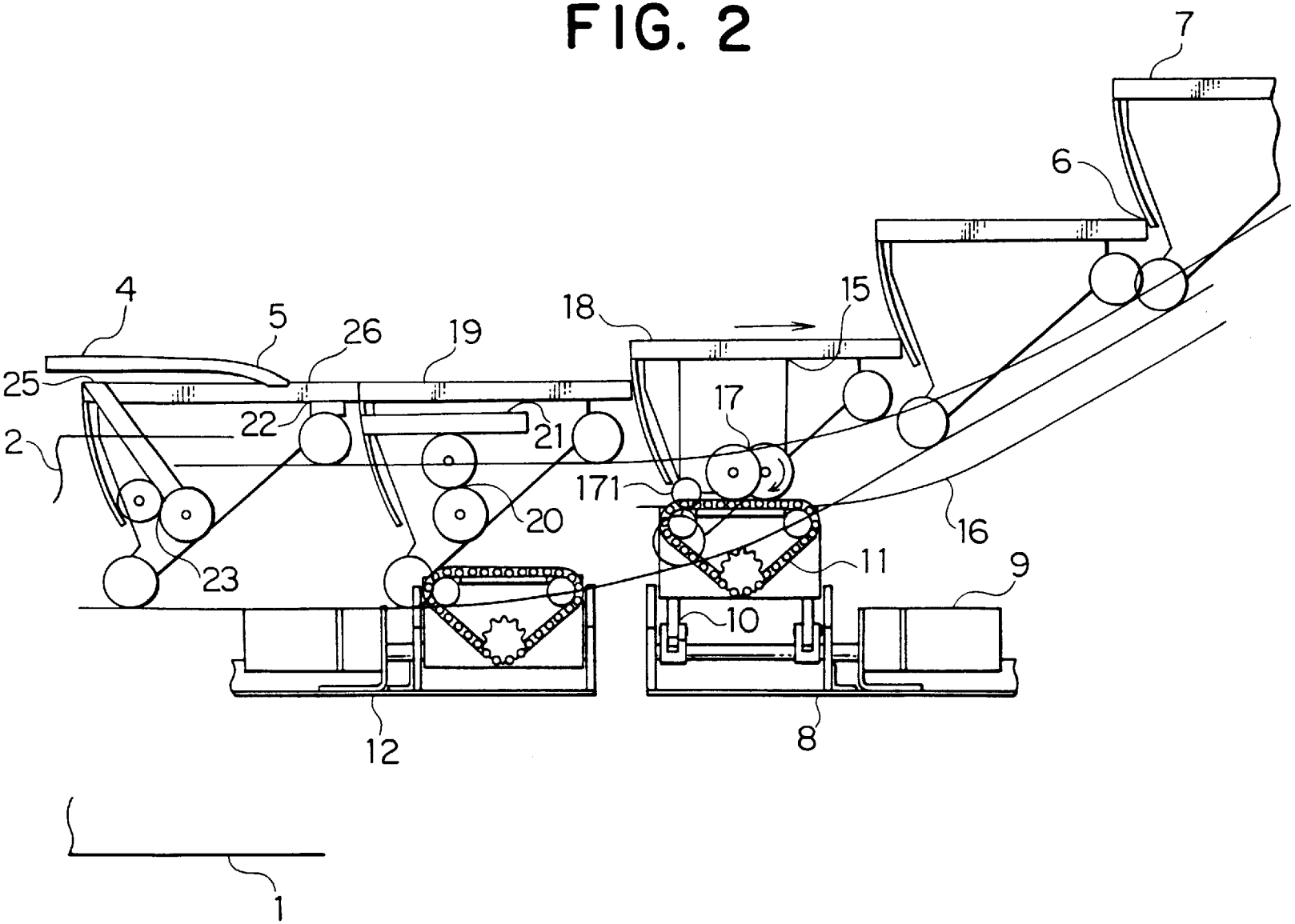
FIG. 2 is an enlarged side view of the state in which the tilting wheel chair step shown in FIG. 1 is in engagement with the first operating mechanism at the lower end entrance of the escalator system.
Figure 3:
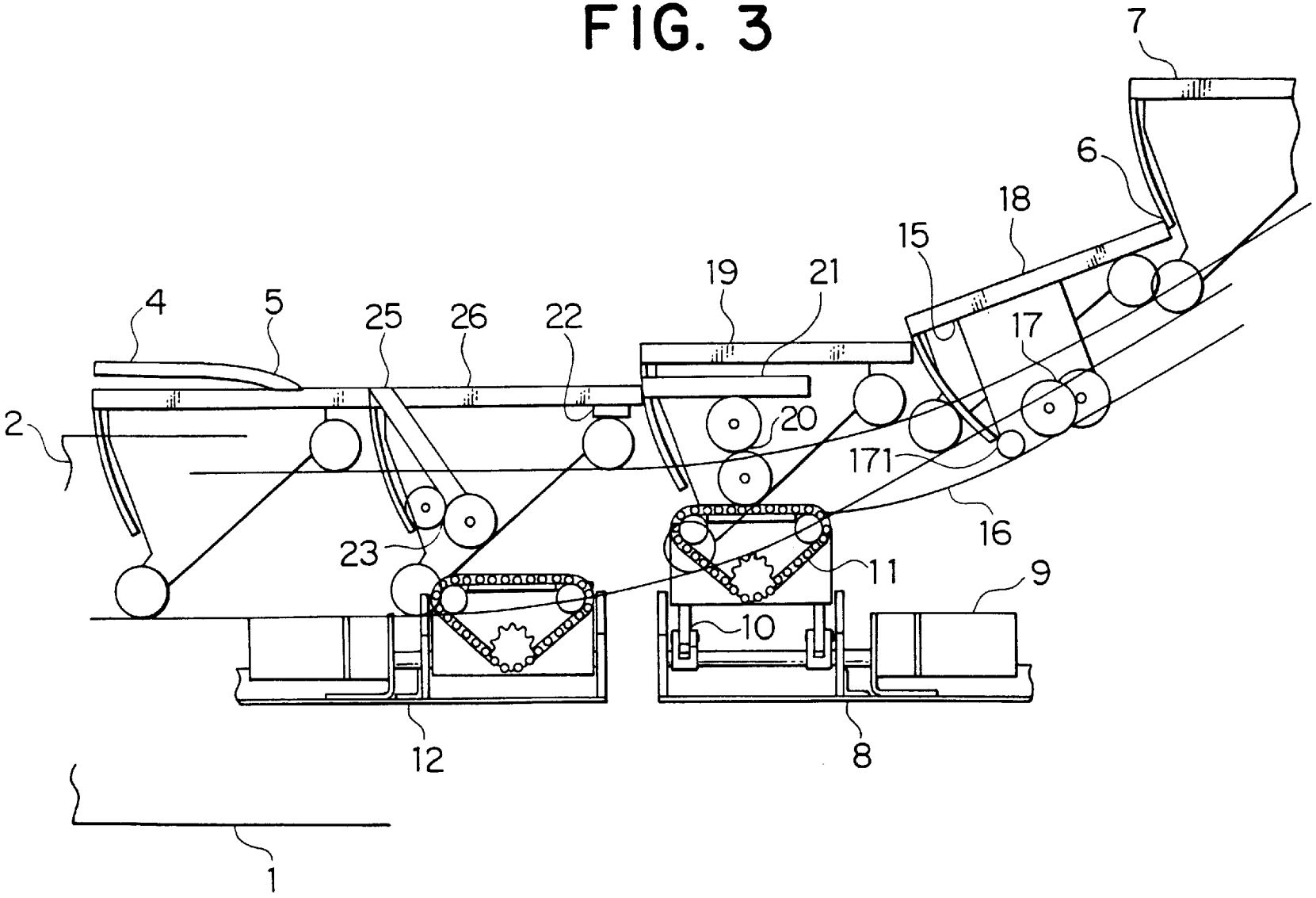
FIG. 3 is an enlarged side view of the state in which the first wheel chair step shown in FIG. 1 is in engagement with the first operating mechanism at the lower end entrance of the escalator system.
Figure 4:
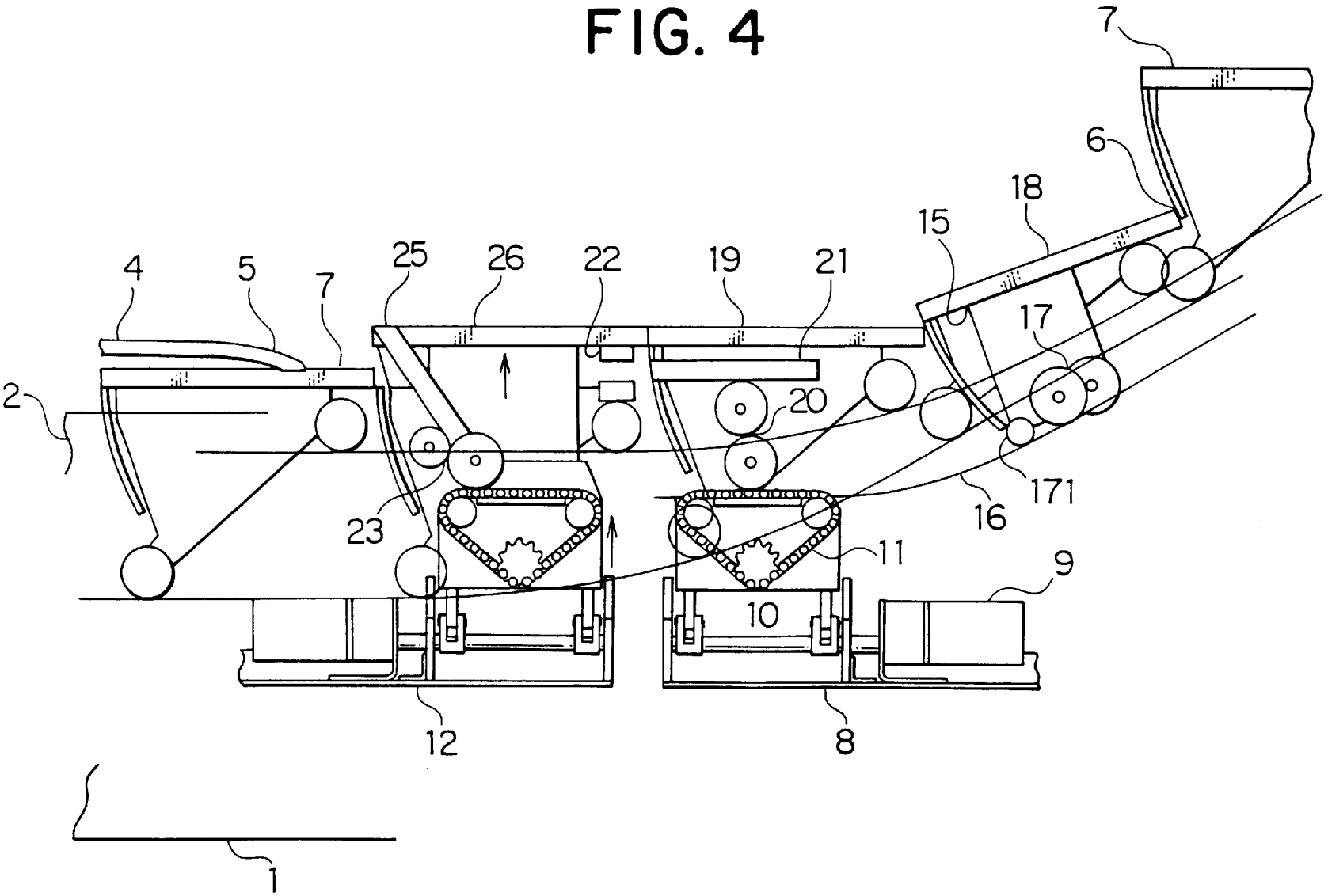
FIG. 4 is an enlarged side view of the state in which the second wheel chair step shown in FIG. 1 is in engagement with the second operating mechanism at the lower end entrance of the escalator system.

FIG. 1 to 12 are views illustrating one embodiment of the present invention, in which FIG. 1 is a schematic side view of an escalator system with wheel chair steps of one embodiment of the present invention, FIG. 2 is an enlarged side view of the state in which the tilting wheel chair step shown in FIG. 1 is in engagement with the first operating mechanism at the lower end entrance of the escalator system, FIG. 3 is an enlarged side view of the state in which the first wheel chair step shown in FIG. 1 is in engagement with the first operating mechanism at the lower end entrance of the escalator system, and FIG. 4 is an enlarged side view of the state in which the second wheel chair step shown in FIG. 1 is in engagement with the second operating mechanism at the lower end entrance of the escalator system.

Figure 5:
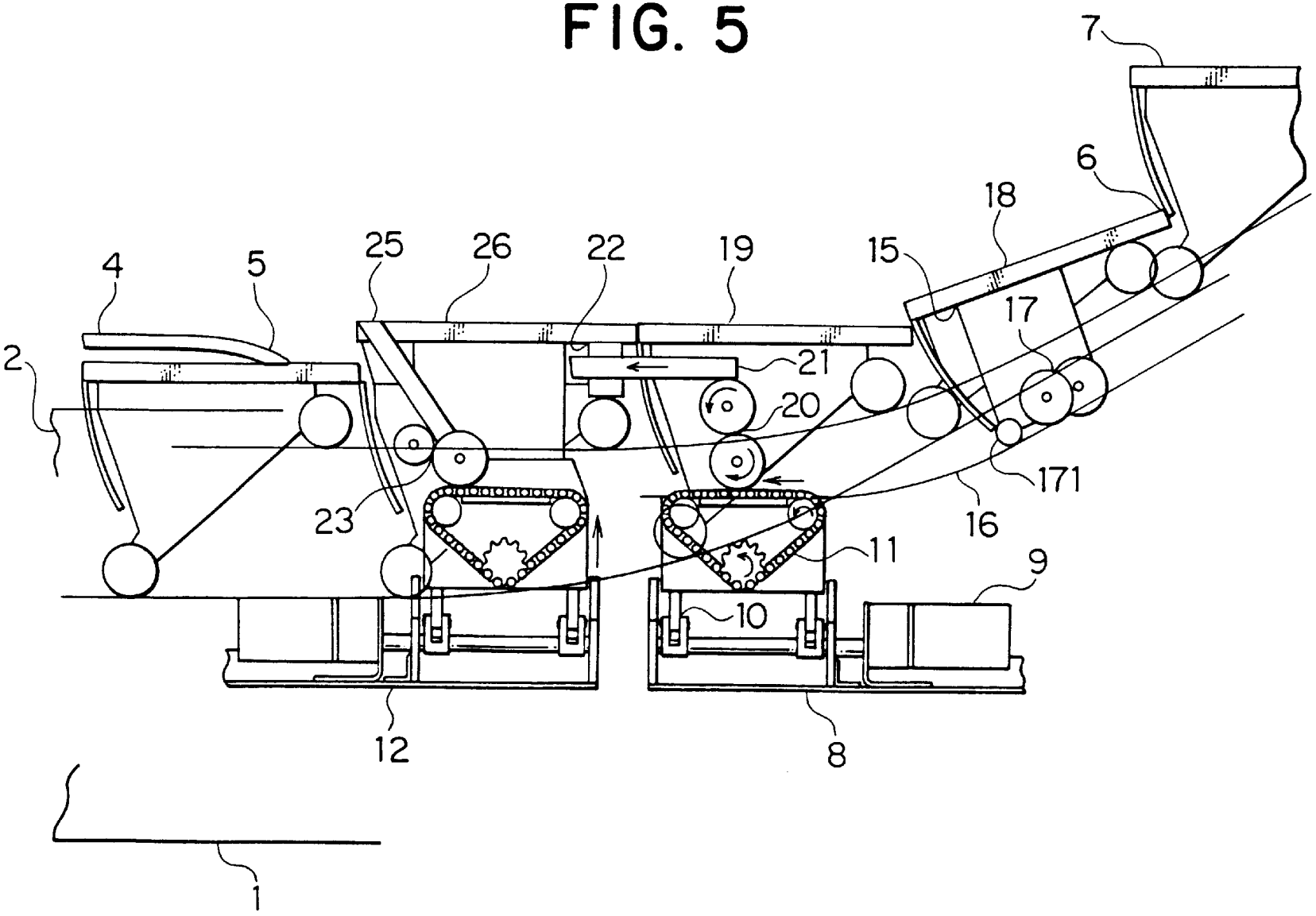
FIG. 5 is an enlarged side view of the state in which the connection arm of the first wheel chair step shown in FIG. 1 is displaced to the lower end side of the main frame at the lower end entrance of the escalator system.
Figure 6:
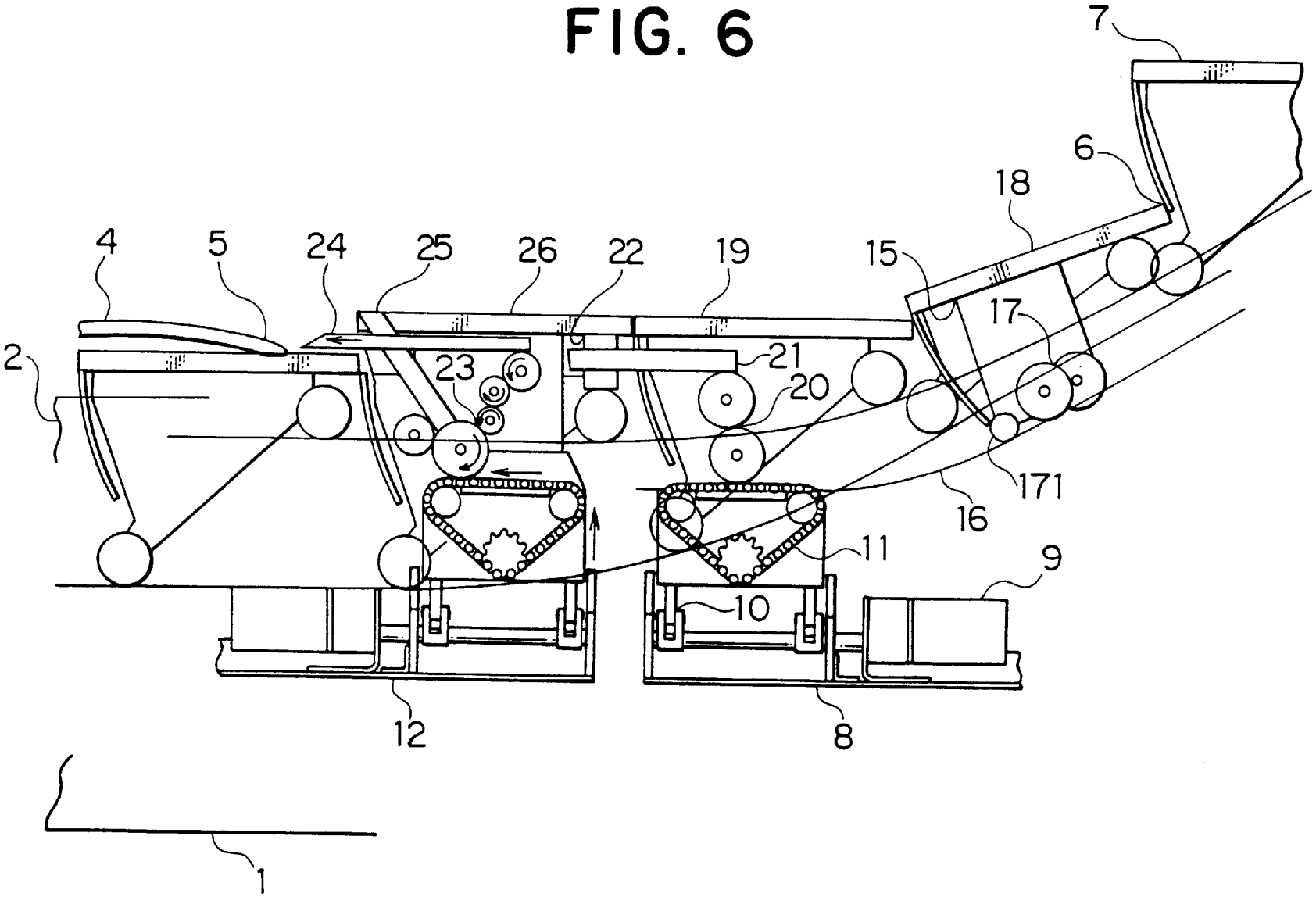
FIG. 6 is an enlarged side view of the state in which the boarding plate of the second wheel chair step shown in FIG. 1 is displaced to the lower end side of the main frame at the lower end entrance of the escalator system.
Figure 7:
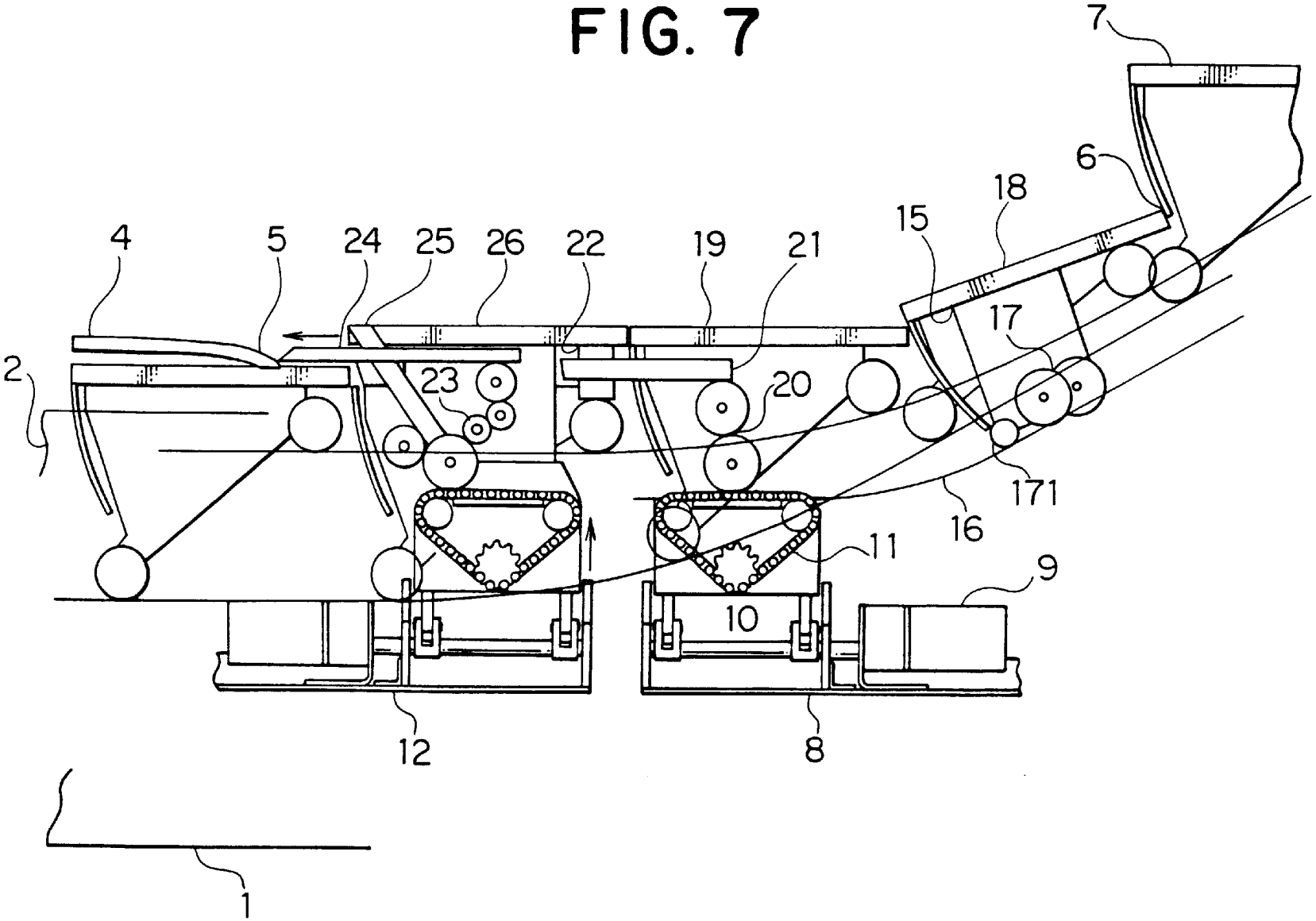
FIG. 7 is an enlarged side view of the state in which the boarding plate of the second wheel chair step shown in FIG. 1 is displaced to the lower end side of the main frame at the lower end entrance of the escalator system.
Figure 8:
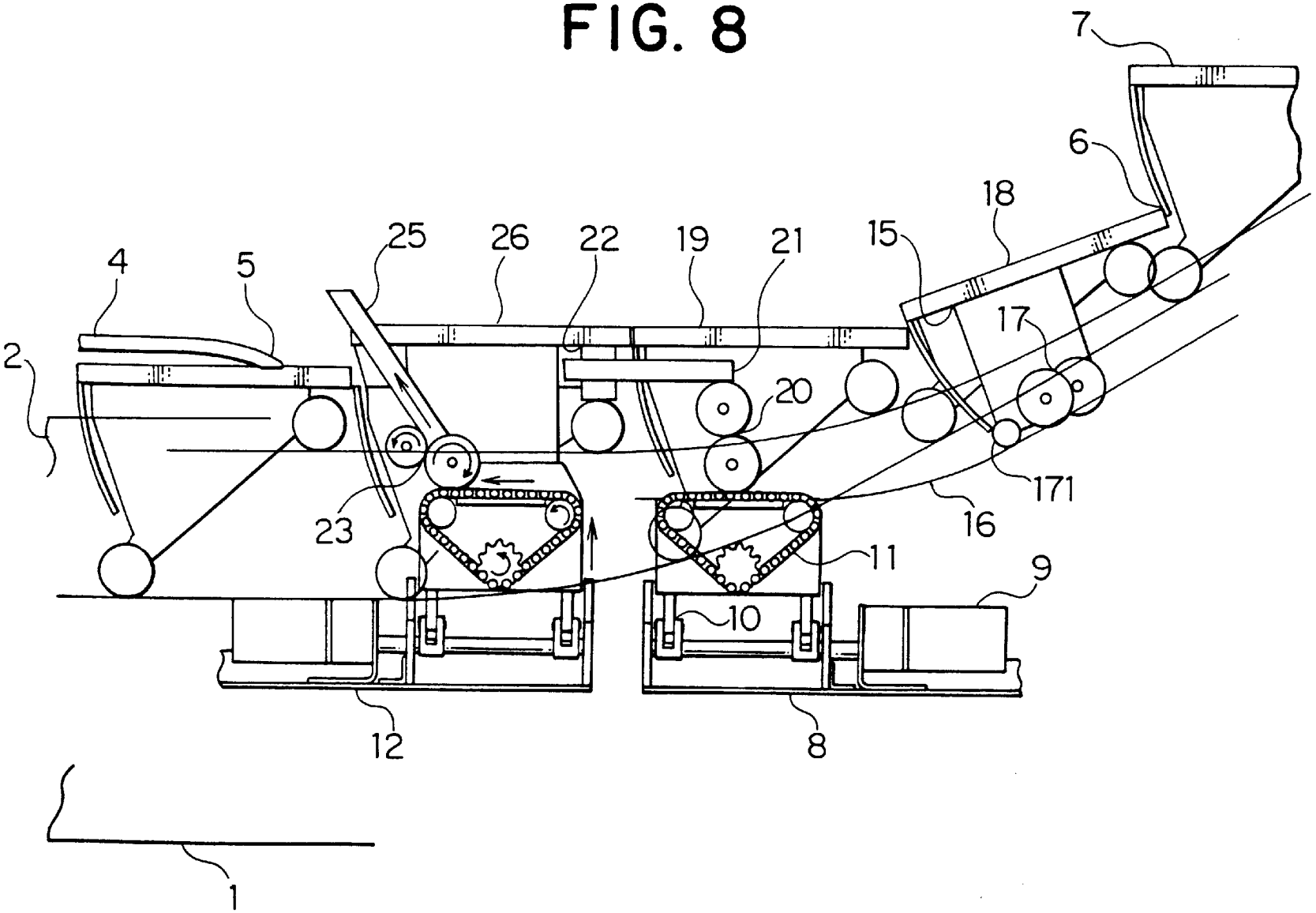
FIG. 8 is an enlarged side view of the state in which the wheel stopper member of the second wheel chair step shown in FIG. 1 is displaced upwardly at the lower end entrance of the escalator system.

Also, FIG. 5 is an enlarged side view of the state in which the connection arm of the first wheel chair step shown in FIG. 1 is displaced to the lower end side of the main frame at the lower end entrance of the escalator system, FIG. 6 is an enlarged side view of the state in which the boarding plate of the second wheel chair step shown in FIG. 1 is displaced to the lower end side of the main frame at the lower end entrance of the escalator system, FIG. 7 is an enlarged side view of the state in which the boarding plate of the second wheel chair step shown in FIG. 1 is displaced to the lower end side of the main frame at the lower end entrance of the escalator system, and FIG. 8 is an enlarged side view of the state in which the wheel stopper member of the second wheel chair step shown in FIG. 1 is displaced upwardly at the lower end entrance of the escalator system.

Figure 9:
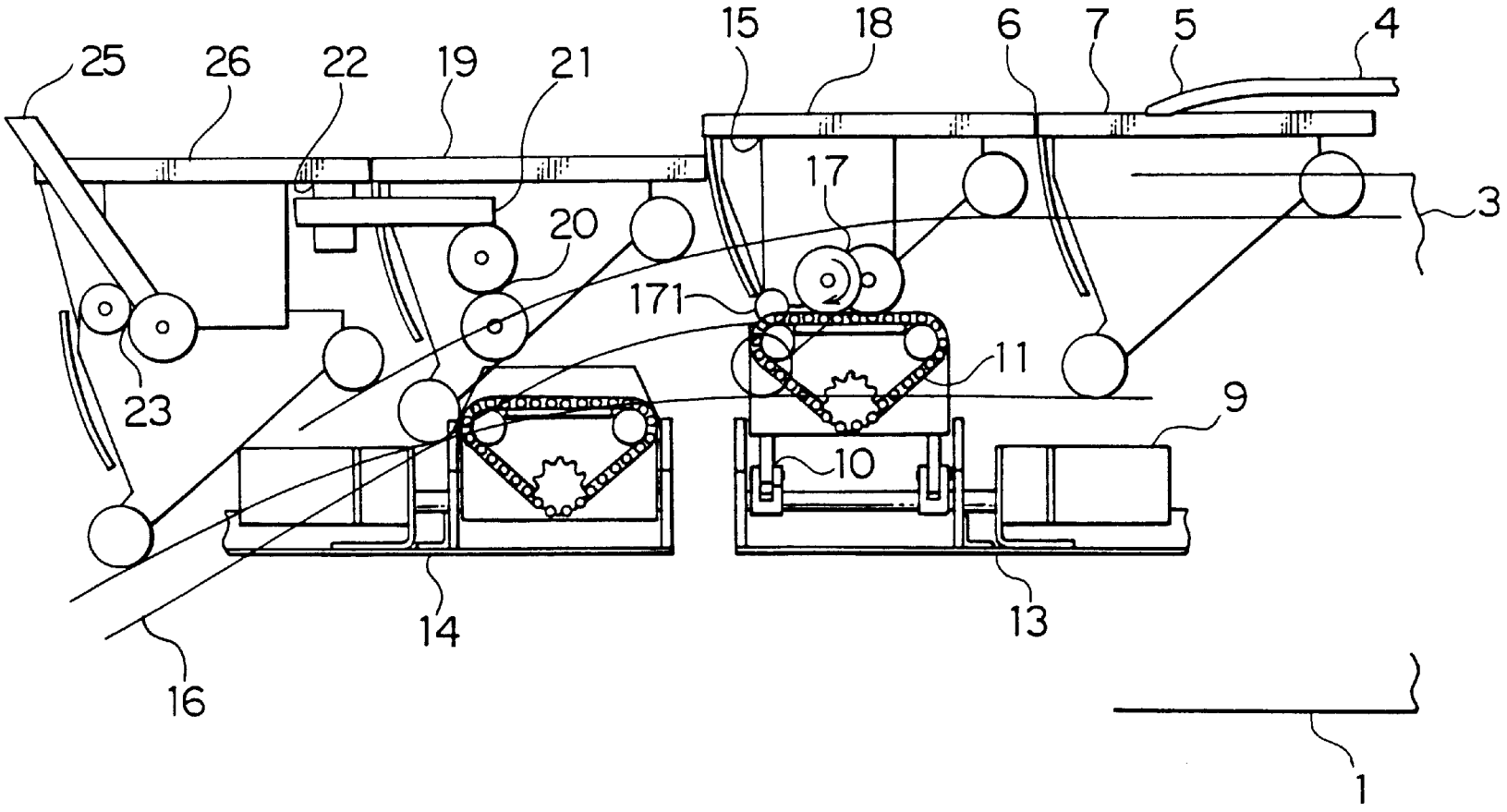
FIG. 9 is an enlarged side view of the state in which the tilting wheel chair step shown in FIG. 1 is in engagement with the third operating mechanism at the lower end entrance of the escalator system.
Figure 10:
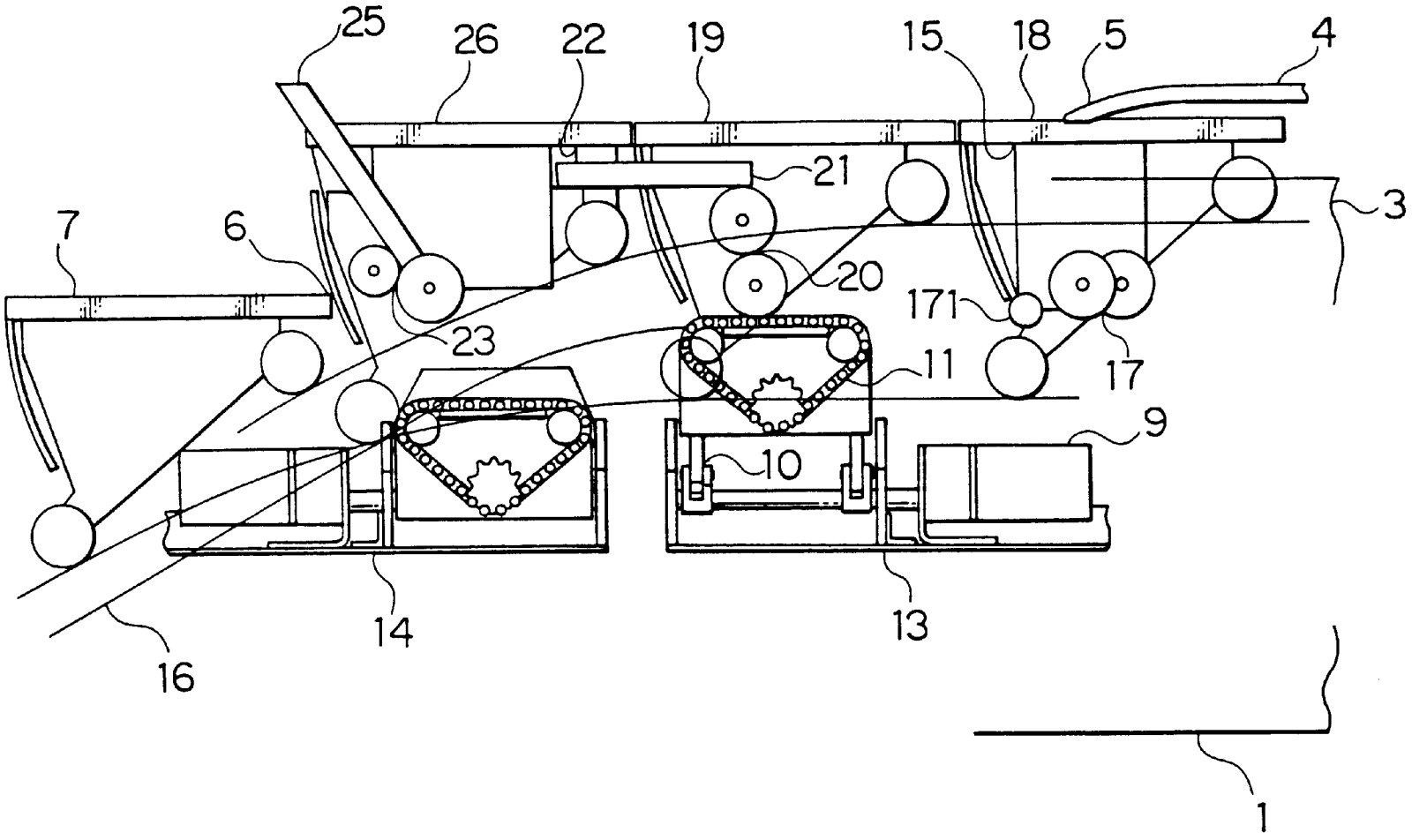
FIG. 10 is an enlarged side view of the state in which the first wheel chair step shown in FIG. 1 is in engagement with the third operating mechanism at the lower end entrance of the escalator system.
Figure 11:
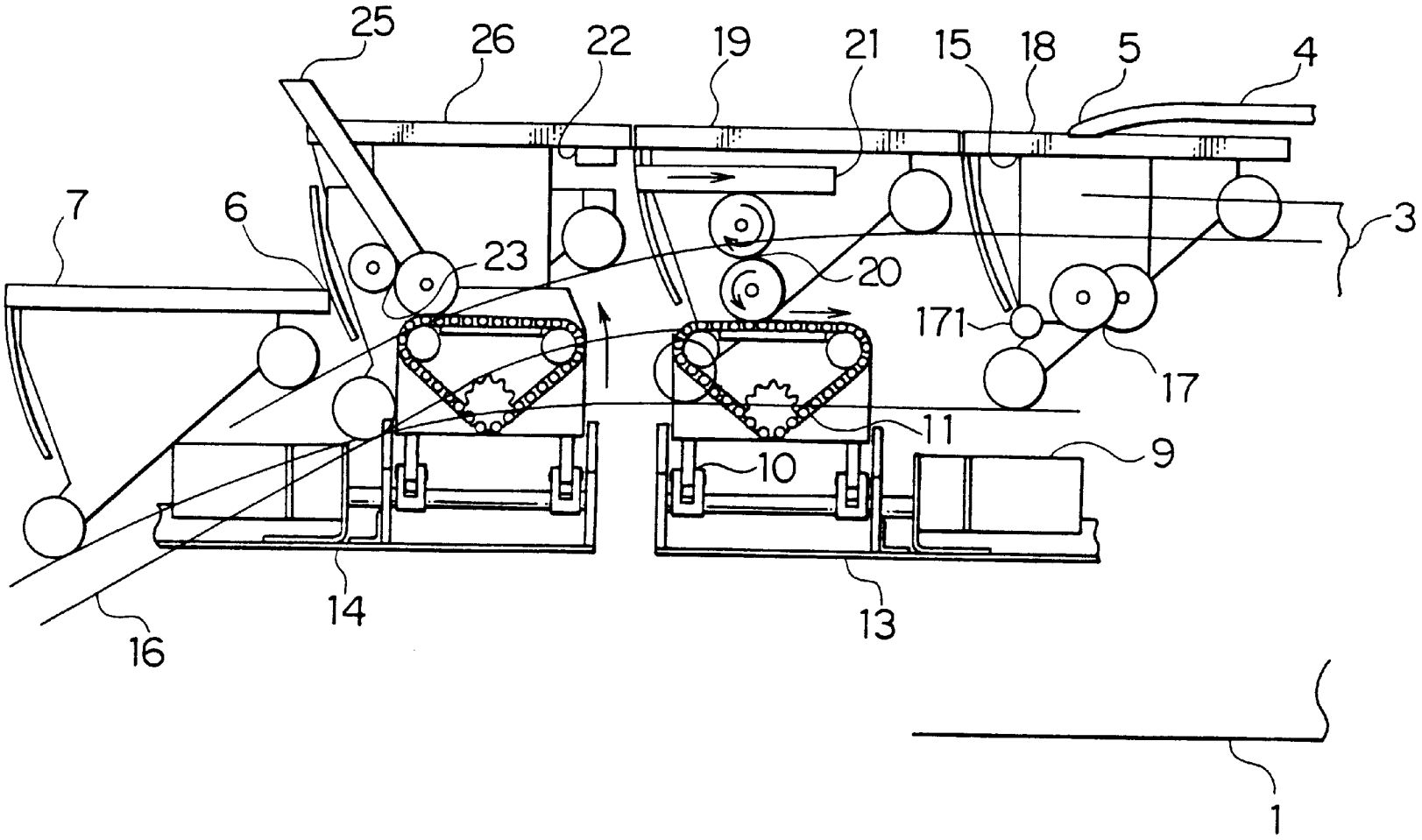
FIG. 11 is an enlarged side view of the state in which the second wheel chair step shown in FIG. 1 is in engagement with the fourth operating mechanism at the lower end entrance of the escalator system.
Figure 12:
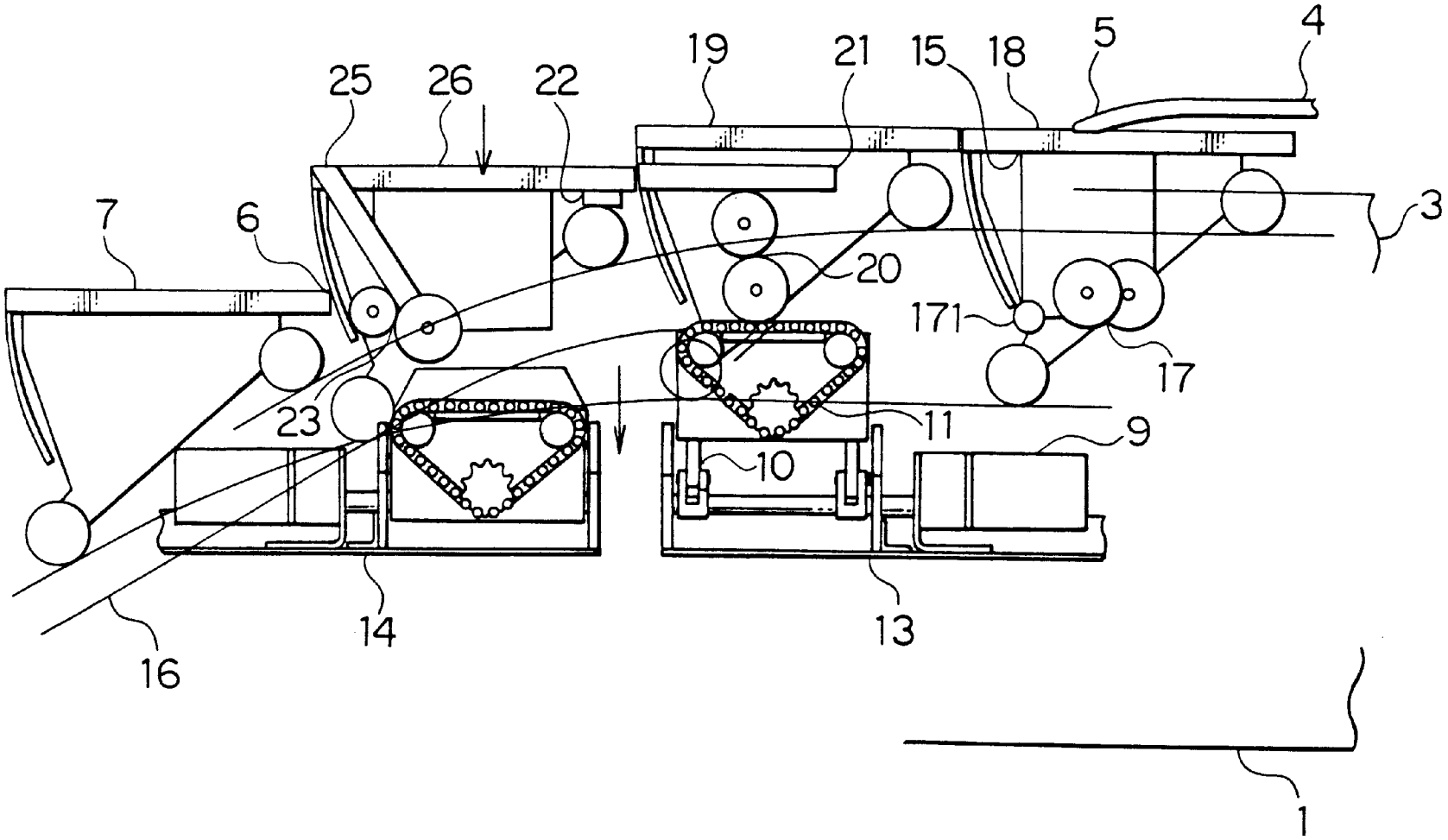
FIG. 12 is an enlarged side view of the state in which the second wheel chair step shown in FIG. 1 is disengaged with the fourth operating mechanism at the lower end entrance of the escalator system.

Further, FIG. 9 is an enlarged side view of the state in which the tilting wheel chair step shown in FIG. 1 is in engagement with the third operating mechanism at the lower end entrance of the escalator system, FIG. 10 is an enlarged side view of the state in which the first wheel chair step shown in FIG. 1 is in engagement with the third operating mechanism at the lower end entrance of the escalator system, FIG. 11 is an enlarged side view of the state in which the second wheel chair step shown in FIG. 1 is in engagement with the fourth operating mechanism at the lower end entrance of the escalator system, and FIG. 12 is an enlarged side view of the state in which the second wheel chair step shown in FIG. 1 is disengaged from the fourth operating mechanism at the lower end entrance of the escalator system.

In these FIGS. 1 to 12, an escalator system of the present invention comprises an escalator main frame 1 having a horizontal lower end 2 and a horizontal upper end 3. The horizontal lower and upper ends 2 and 3 each define an entrance and exit 4 provided with a comb plate 5. The escalator system also comprises a plurality of steps 7 connected into an endless conveyor loop 6 circulating along the main frame 1.

Disposed within the main frame 1 at a position not far from the lower end 2 of the main frame 1 is a first operating mechanism 8 which comprises an electric motor 9, a crank mechanism 10 driven by the electric motor 9 for up and down movements and a power transmission mechanism 11 including a roller chain driven by another electric motor (not shown).

A second operating mechanism 12 is disposed within the main frame 1 at a position closer to the lower end 2 of the main frame 1 as compared to that of the first operating mechanism 11. The second operating mechanism 12 has a similar construction and comprises an electric motor 9, a crank mechanism 10 and a power transmission mechanism 11.

The escalator system also comprises a third operating mechanism 13 disposed in the main frame 1 at a position close to the upper end 3 of the main frame 1. The third operating mechanism 13 has similar construction to that of the first operating mechanism 8 and comprises an electric motor 9, a link mechanism 10 and a power transmission mechanism 11. A fourth operating mechanism 14 is disposed in the main frame 1 at a position closer to the upper end 3 of the main frame 1 than the third operating mechanism 13. The fourth operating mechanism 14 has a similar construction to that of the first operating mechanism 8 and comprises an electric motor 9, a link mechanism 10 and a power transmission mechanism 11.

The escalator system comprises a tilting wheel chair step 15 connected between the steps 7 of the endless conveyor loop 6. The tilting wheel chair step 15 comprises a tilting mechanism 17 including a tilting roller 171 which, when necessary, engages and driven by the first operating mechanism 8 to be displaced so as to be guided by a tilting wheel chair step rail 16 mounted to the main frame 1 and a tilting tread board 18 moved to a tilted position by the tilting mechanism 17.

A first wheel chair step 19 is connected between the steps 7 of the endless conveyor loop 6 and at the side of the tilting wheel chair step 15 close to the lower end of the main frame 1. The first wheel chair step 19 is provided with a connection arm 21 capable of being moved into a position projected toward the lower end of the main frame 1 by a shifter mechanism 20 which is brought into engagement with the first operating mechanism 8 and driven when necessary.

The escalator system further comprises a second wheel chair step 22 connected between the steps 7 of the endless conveyor loop 6 and at the side of the first wheel chair step 19 close to the lower end of the main frame 1. The second wheel chair step 22 comprises a boarding plate 24 capable of being displaced into a projected position in which it is projected toward the lower end 2 of the main frame 1 by a shifter mechanism which is a displacement mechanism 23 engaged with and driven by the second operating mechanism 12 when necessary, a wheel stopper member 25 capable of projecting when actuated by the displacement mechanism 23 and a rising tread board 26 capable of being displaced in a raised position by the displacement mechanism 23 and supported by a connection arm 21 projected from the first wheel chair step 19 so as to be further elevated. It is seen that a wheel chair 27 is being mounted on and conveyed by an enlarged tread surface defined by combining the treads of the first wheel chair step 19 and the second wheel chair step 22.

In usual operation, the escalator system is operated in the state in which the transmission mechanism 11 of each of the first operating mechanism 8, the second operating mechanism 12, the third operation mechanism 13 and the fourth operating mechanism 14 is maintained at the lowered position. Also, the tilting tread board 18 of the tilting wheel chair step 15 is kept at the horizontal position and the connection arm 21 of the first wheel chair step 19 is maintained at the retracted position. The boarding plate 24, the wheel stopper member 25 and the rising tread board 26 of the second wheel chair step 22 are maintained at their retracted positions.

In this state, the endless conveyor loop 6 of the escalator system is driven to circulate along the main frame 1 so that general passengers may be conveyed by the steps 7, the tilting wheel chair step 15, the first wheel chair step 19 and the second wheel chair step 22 in normal positions. It is to be noted that, because of the circulating operation of the endless conveyor loop 6, all the steps such as the first wheel chair step 19 and the like travel from entrance 4 of the lower end 2 horizontally along the horizontal section of the guide rail and then gradually increase the climb rate as they travel along the transient section of the guide rail until they reache the sloped section of the guide rail along which the steps move upwardly along the constant slope.

When the step 7 reaches the upper horizontal end 2, the step 7 travels along the transition section to gradually decrease the climb rate and moves into the upper horizontal section at the exit 3 of the main frame 1 in which the steps 7 are horizontally moved.

When the escalator system is operated in the downward direction, the steps 7 travels in the direction opposite to that as above described and the steps 7 move in the downward direction.

When the wheel chair 27 is to be conveyed upwardly, i. e., the wheel chair 27 is desired to be conveyed from the entrance 4 at the lower end 2 to the exit 4 at the upper end 3, the escalator system is switched to the wheel chair carrying operation by the wheel chair operating switch (not shown), whereby the first operating mechanism 8 is energized and its power transmission mechanism 11 is elevated and the conveyor belt 6 is driven upwardly.

In the state shown in FIG. 2, the tilting mechanism 17 of the tilting wheel chair step 15 engages with and passes through the power transmission mechanism 11 of the first operating mechanism 8. Then, the horizontal orientation of the tilting mechanism 17 is released to allow the tilting tread board 18 to tilt as shown in FIG. 3, this tilted state being maintained by the tilting wheel chair step rail 16 which engages and guides the tilting roller 171.

When the escalator system is in the state shown in FIG. 3, in which the tilting tread board 18 is tilted, the first wheel chair step 19 is at the initial stage of the gradually tilting zone and has a difference in elevation with respect to the horizontally moving second wheel chair step 22 and in which the step 7 on the lower side close to the lower end 2 of the main frame 1 of the second wheel chair step 22 comes out from the comb plate 5 by about ⅓ of the length in the direction of movement, the conveyor belt 6 stops.

Then, the second operating mechanism 12 is energized and its power transmitting mechanism 11 is raised to engage with and drive the shifter mechanism 23 of the second wheel chair step 22. This causes the rising tread board 26 to be released to raise to the position of the tread board of the first wheel chair step 19 as shown in FIG. 4.

Then, in the state illustrated in FIG. 4, the power transmission mechanism 8 of the first operating mechanism 11 is energized and the connection arm 21 is moved to its position projected toward the lower end by means of the shifter mechanism 20 engaged with the power transmission mechanism 11. This causes the rising tread board 26 of the second wheel chair step 22 to be supported by the connection arm 21 as shown in FIG. 5. Then, the power transmission mechanism 11 of the second operating mechanism 12 is energized and the boarding plate 24 shifts and projects toward the lower end 2 of the main frame 1 by means the displacement mechanism 23 of the second wheel chair step 22. Therefore, the boarding plate 24, passing through the position shown in FIG. 6, is placed in the position in which it abuts against the comb 5 at the lower end 2 of the main frame 1 as shown in FIG. 7.

It is also possible to arrange so that the boarding plate 24 shifts toward an lower end 2 of the main frame 1 to overlap the upper surface of the boarding entrance 4 at the lower end 2 and, even with such the arrangement, the function which will be described later can be obtained. Then, in the state shown in FIG. 7, the wheel chair 27 is mounted, and the power transmission mechanism 11 of the second operating mechanism 12 is energized to retract the boarding plate 24 of the second wheel chair step 22 by means of the displacement mechanism 23 of the second wheel chair step 22. The displacement mechanism 23 also causes the wheel stopper member 25 to project to achieve the state shown in FIG. 8.

Further, it is possible to arrange the structure so that, instead of the wheel stopper member 25, the boarding plate 24 upwardly rotates to serve as a wheel stopper member. In FIG. 8, the mounted wheel chair 27 on the steps is prevented from being moved toward the lower end 2 of the main frame I by the wheel stopper member 25 in the projected position, and the escalator system is upwardly operated in this state. Thus, the tread board of the first wheel chair step 19 and the rising tread board 26 of the second wheel chair step 22 are maintained in a common horizontal plane and are upwardly moved in this state maintained, allowing the wheel chair 27 to be conveyed by the tilting wheel chair step 15, the first wheel chair step 19 and the second wheel chair step 22.

Then, when the tilting wheel chair step 15 and the like are conveyed by the conveyor belt 6 and approach the exit 4 of the upper end 2 of the main frame 1, they are carried in the transition section in which the slope gradually decreases, where the holding of the tilted position of the tilting tread board 18 of the tilting wheel chair step 15 is released through the tilting rollers 171 due to the tilting wheel chair step rails 16. Also, the third operating mechanism 13 is energized and its power transmitting mechanism 11 is positioned at the raised position as shown in FIG. 9. When the tilting mechanism 17 engages and passes the raised power transmitting mechanism 11, the tilting mechanism 17 is returned to its horizontal position and held therein.

When the conveyor loop 6 is further moved and reached at the position shown in FIG. 10 where the tilting tread board 18 of the tilting wheel chair step 15 is placed under the comb plate 5 of the exit 4 at the upper end 3 by about two-thirds of the length in the direction of movement, the conveyor loop 6 is stopped. Then, with the steps in the positions shown in FIG. 10, the wheel chair 27 lands on the exit 4 of the upper end 2 of the main frame 1 from the first wheel chair step 19 and the like.

Then, the fourth operating mechanism 14 is energized to move its power transmission mechanism 11 to the raised position and supports the rising tread board 26 of the second wheel chair step 22. In this state, the power transmission mechanism 11 of the third operating mechanism 13 is operated to retract the connection arm 21 by means of the shifter mechanism 20 of the first wheel chair step 19. This causes the connection between the first wheel chair step 19 and the second wheel chair step 22 to be released to become the state shown in FIG. 11.

Then, the power transmission mechanism 11 of the fourth operating mechanism 14 is operated to retract the wheel stopper member 25 by means of the displacement mechanism 23. Also, the fourth operating mechanism 14 is energized so that its operating mechanism 11 is lowered and the rising tread board 26 of the second wheel chair step 22 is lowered. Then, the power transmission mechanism 11 of the fourth operating mechanism 14 is energized to hold the rising tread board 26 at the lowered position by means of the displacement mechanism 23 as shown in FIG. 12. Then, the upward conveying operation for the wheel chair 27 is completed and the escalator system with wheel chair steps are switched to the normal operation, whereby the conveyor belt 6 is moved in the usual manner.

By the operating method as above described, the space for mounting the wheel chair 27 thereon or the horizontal surface for mounting the wheel chair 27 thereon is defined by the first wheel chair step 19 and the second wheel chair step 22, the horizontal surface being defined by the step 7 positioned at the side of the lower end 2 of the main frame 1 of the second wheel chair step 22 in the state shown in FIG. 3 where the step 7 projects from the comb plate 5 by about one-third of its length in the direction of movement as well as the length of the end portion of the main frame 1 corresponding to the second wheel chair step 22 in the horizontal movement.

Therefore, it is possible to obtain an escalator system with wheel chair steps in which the overall length of the escalator main frame 1 is not required to be particularly increased, alleviating the mounting restrictions based on the installation space occupied by the escalator system with wheel chair steps. Also, when the ordinary escalator system that has already been installed is to be converted into the wheel chair escalator system, the already mounted main frame can be utilized as it is and the conversion operation is simple, decreasing the cost for the conversion.

It is to be noted that, in the embodiment shown in FIGS. 1 to 12, in the state shown in FIG. 4, the rising tread board 26 of the second wheel chair step 22 is raised and, in the state shown in FIG. 12, the rising tread board 26 is lowered. The height or the stroke of elevation of this rising tread board 26 is not necessarily equal to that at the upper end 2 of the main frame 1 and that at the lower end 3 of the main frame 1 and it is possible to have different rising strokes according to the convenience of the structure or the like of the boarding plate 24. The rising stroke of the rising tread board 26 may be suitably determined by changing the rising strokes of the power transmission mechanism 11 of the second operating mechanism 12 and the power transmission mechanism 11 of the fourth operating mechanism 14.

Also, there are some escalator systems having wheel chair steps in which the tread board corresponding to the rising tread board 26 of the second wheel chair step 22 is inverted to be deployed at the position close to the entrance 4 to provide a space for mounting the wheel chair thereon. In the escalator system of this type, the attendant to the wheel chair may be caught at his or her foot by the inverting tread board. However, no such disadvantage occurs in the embodiment shown in FIGS. 1 to 12.

Figure 13:
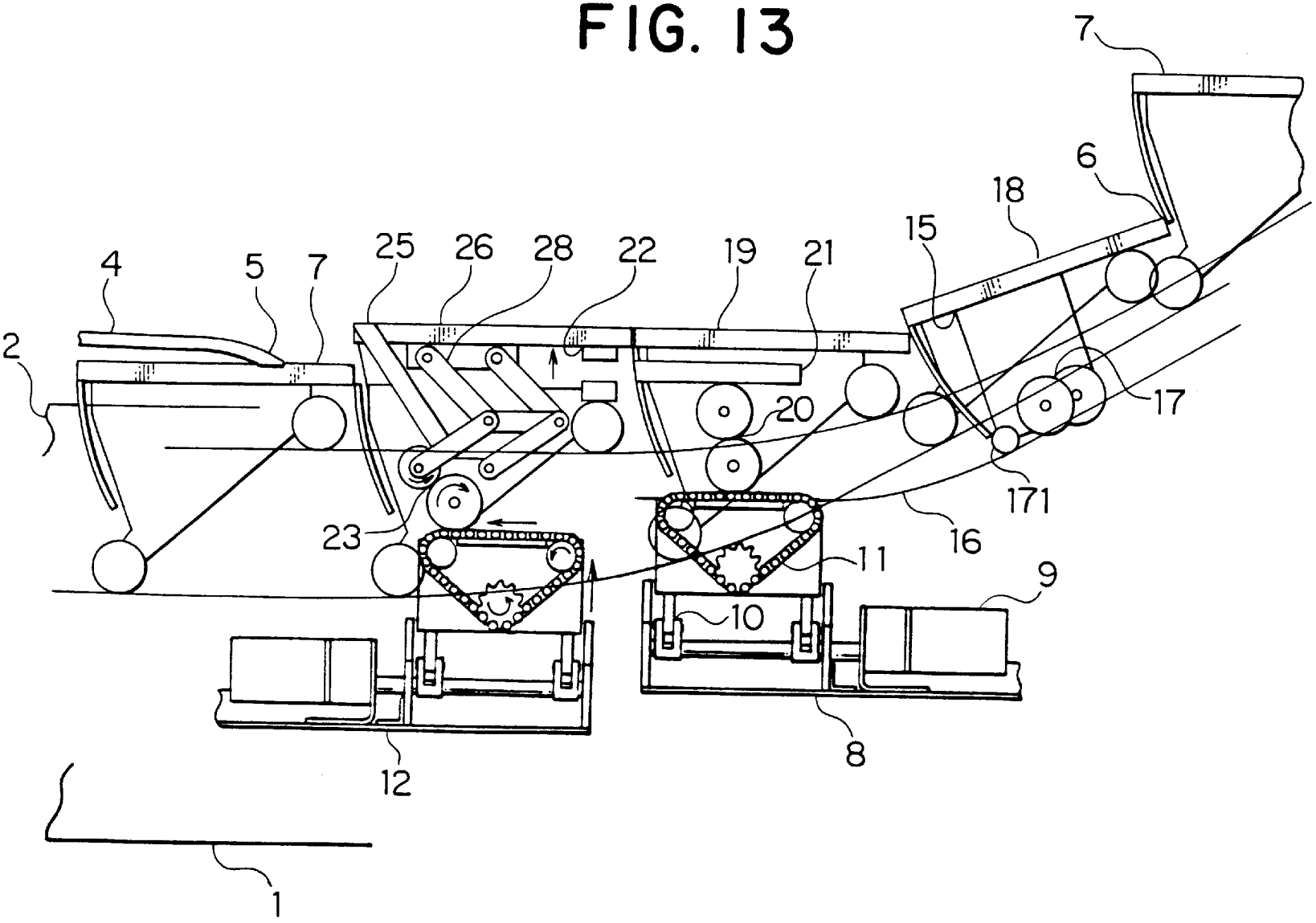
FIG. 13 is a view corresponding to FIG. 4 but illustrating the second embodiment of the present invention.

FIG. 13 is a view corresponding to FIG. 4 and illustrating another embodiment of the present invention, the escalator system having the construction similar to those shown in FIGS. 1 to 12 except for FIG. 13. In the figure, in which the same reference numerals as those in FIG. 4 designate corresponding components, reference numeral 28 is a rising link mechanism disposed in the second wheel chair step 22 and constituting the main portion of the displacement mechanism 23 for raising and lowering the rising tread board 26 when it is driven by the raised power transmission mechanism 11 of the second operating mechanism 12.

In the escalator system having wheel chair steps having the construction as above described, the first wheel chair step 19, the second wheel chair step 22 and the first to the fourth operating mechanisms 8, 12, 13 and 14 similar to those shown in FIGS. 1 to 12 are provided and the operation is similar to that described and illustrated in conjunction with FIGS. 1 to 12. Therefore, a function similar to that of the embodiment shown in FIGS. 1 to 12 can be obtained in this embodiment shown in FIG. 13, although its detailed description is omitted.

In a further modification as another embodiment of the present invention, by utilizing the embodiment of FIG. 13, the roller chain of the power transmission mechanism 11 of the second operating mechanism 12 is made a stationary structure and, by the horizontal movement of the second wheel chair step 22, the sprocket wheel of the displacement mechanism 23 of the second wheel chair step 22 is engaged and driven. The rotation of the sprocket wheel of the displacement mechanism 23 causes the rising tread board 26 to be raised by means of the displacement mechanism 23.

In the escalator system having wheel chair steps having the construction as just above described, the first wheel chair step 19, the second wheel chair step 22 and the first to the fourth operating mechanisms 8, 12, 13 and 14 similar to those shown in FIGS. 1 to 12 are provided and the operation is similar to that described and illustrated in conjunction with FIGS. 1 to 12. Therefore, a function similar to that of the embodiment shown in FIGS. 1 to 12 can be obtained in this embodiment shown in FIG. 13, although its detailed description is omitted.

Figure 14:
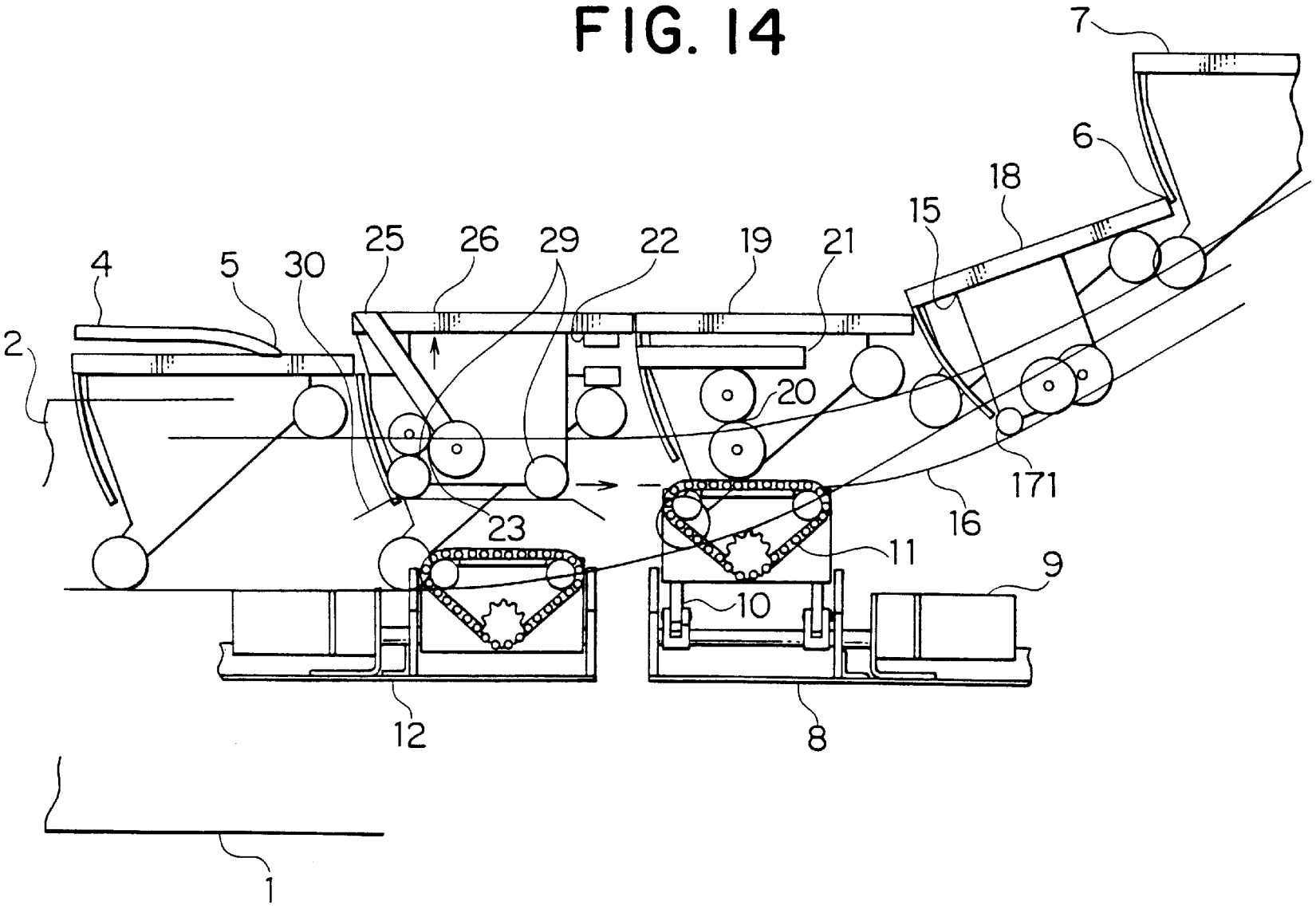
FIG. 14 is a view corresponding to FIG. 4 but illustrating the fourth embodiment of the present invention.

FIG. 14 illustrates yet another embodiment of the present invention and corresponds to FIG. 4. The escalator system having the wheel chair steps has the similar structure to that shown in FIGS. 1 to 12 except for FIG. 14. In the figure, the reference numerals the same as those shown in FIG. 4 designate corresponding components and reference numeral 29 is a displacement mechanism composed of a roller pivotally disposed at the lower edge portion of the rising tread board 16 of the second wheel chair step 22.

Reference numeral 30 is an operating mechanism composed of a rail-like cam, the operating mechanism 30 being disposed on the main frame 1 at the position corresponding to the position for raising the rising tread board 26 at the lower end 2 of the main frame 1 for engaging the displacement mechanism 29 to raise the rising tread board 26 by the horizontal movement of the second wheel chair step 22.

In the escalator system having wheel chair steps having the construction as above described, the first wheel chair step 19, the second wheel chair step 22 and the first to the fourth operating mechanisms 8, 12, 13 and 14 similar to those shown in FIGS. 1 to 12 are provided and the operation is similar to that described and illustrated in conjunction with FIGS. 1 to 12. Therefore, a function similar to that of the embodiment shown in FIGS. 1 to 12 can be obtained in this embodiment shown in FIG. 14, although its detailed description is omitted.

As has been described, the escalator system with wheel chair steps of the present invention comprises a main frame having an upper end and a lower end, a plurality of steps connected in an endless conveyor loop and capable of circulating along the main frame, and an operating mechanism disposed at a position close to the ends of the main frame. The escalator system further comprises a first wheel chair step disposed between the steps and having a connection arm capable of being displaced toward the lower end of the main frame by a shifter mechanism engageable with the operating mechanism when necessary. The escalator system also comprises a second wheel chair step disposed between the steps and having a rising tread board capable of being raised by a raising mechanism engageable with the operating mechanisms when necessary and a boarding plate capable of being displaced toward the lower end of the main frame by a shifter mechanism engageable with the operating mechanism when necessary. The rising tread board, when raised, is supported by the connection arm displaced in a projected position and defining a combined and enlarged horizontal surface together with the tread board of the first wheel chair step.

Therefore, the escalator system with wheel chair steps can be constructed with a main frame having an entrance/exit space in which at most two steps are horizontally disposed as in an ordinary escalator system, so the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the escalator system with wheel chair steps of the present invention, when the first wheel chair step is travelling in an initial stage of a transitional travel path and provides a difference in elevation relative to the second wheel chair step travelling in a horizontal travel path, the rising tread board raised by the raising mechanism is supported by a support arm at a location at which an enlarged horizontal tread surface is defined by the tread boards of the first and second wheel chair steps.

Therefore, the escalator system with wheel chair steps can be constructed with a main frame having an entrance/exit space in which at most two steps are horizontally disposed as in an ordinary escalator system, so that the entire length of the main frame of the escalator system with wheel chair steps does not need to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the escalator system with wheel chair steps of the present invention, when the first wheel chair step is travelling in an initial stage of a transitional travel path and provides a difference in elevation relative to the second wheel chair step travelling in a horizontal travel path and the endless conveyor loop is in the stopped state, the rising tread board raised by the raising mechanism is supported by a support arm at a location in which an enlarged horizontal surface continuous to the tread board of the first wheel chair step is defined, and wherein the first wheel chair step and the second wheel chair step travel alone a constant slope travel path with their tread boards maintained in the position defining the enlarged horizontal surface.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

According to a method for operating an escalator system with wheel chair steps of the present invention with a main frame having an upper end and a lower end and a plurality of steps connected in an endless conveyor loop for circulating along the main frame, the method comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position on the lower end side of the main frame and the first wheel chair step is positioned higher than the second wheel chair step. A boarding plate extends from the second wheel chair step having the raised rising tread board toward the lower end side of the main frame.

Therefore, the escalator system with wheel chair steps can be constructed with a main frame having an entrance/exit space in which at most two steps are horizontally disposed as in a ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to another method of the present invention for operating an escalator system with wheel chair steps that comprises a main frame having an upper end and a lower end and a plurality of steps connected in an endless conveyor loop for circulating along the main frame, the method comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position at an end of the main frame and the first wheel chair step positions higher than the second wheel chair step, and connecting the first wheel chair step to the second wheel chair step having the raised rising tread board with a connection arm of the first wheel chair step.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to another method of the present invention for operating an escalator system with wheel chair steps comprising a main frame having an upper end and a lower end and a plurality of steps connected in an endless conveyor loop for circulating along the main frame, the method comprises raising a rising tread board of the second wheel chair step to define a combined and enlarged horizontal surface together with the first wheel chair step when a second wheel chair step disposed between the steps of the endless conveyor loop circulating along a main frame and a first wheel chair step disposed adjacent to the first wheel chair step on the upper end side of the main frame are positioned at a predetermined position at an end of the main frame and the first wheel chair step is positioned higher than the second wheel chair step, and moving the first wheel chair step and the second wheel chair step along a constant slope travel path with their tread boards maintained in the position defining the enlarged horizontal surface.

Also, according to the method for operating an escalator system with wheel chair steps, the method comprises extending the boarding plate to a position projected from the second wheel chair step for allowing a wheel chair user to board onto the steps, retracting the boarding plate, and extending a wheel stopper on the second wheel chair step to a position projected from a lower end side of the main frame of a tread of the second wheel chair step.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises moving a slope tread board of a drop-down wheel chair step to a dropped-down position upon conveying a wheel chair, and the drop-down step connected between the steps in the endless conveyor loop and disposed adjacent to the first wheel chair step and on an upper end side of the main frame.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises stopping the first wheel chair step and the second wheel chair step at a predetermined position at the end portion of the main frame, and operating an operating mechanism in a rising mode to raise the rising tread board of the second wheel chair step.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises stopping the first wheel chair step and the second wheel chair step at a predetermined position at the end portion of the main frame, and operating an operating mechanism in a driving mode to raise the rising tread board of the second wheel chair step.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises stopping the first wheel chair step and the second wheel chair step at a predetermined position at the end portion of the main frame, and operating an operating mechanism into engagement with the rising tread board of the second wheel chair step.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises moving the drop-down tread board of the drop-down wheel chair step to a drop-down position when the first and the second wheel chair steps are stopped at a predetermined position at the upper end portion of the main frame.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps is not needed to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the method comprises moving the drop-down wheel chair step to a position below the comb plate of the upper end potion of the main frame when the first and the second wheel chair steps are stopped at a predetermined position at the upper end portion of the main frame.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps does not need to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, according to the method for operating an escalator system with wheel chair steps, the amount of raised displacement of the rising tread board, at the lower horizontal run of the main frame when the rising tread board of the second wheel chair step is raised to define the enlarged horizontal surface together with the first wheel chair step, is different from an amount of the raised displacement of the rising tread board at the upper horizontal run.

Therefore, the escalator system with wheel chair steps can be constructed with a main frame having an entrance/exit space in which at most two steps are horizontally disposed as in the ordinary escalator system, so that the entire length of the main frame of the escalator system with wheel chair steps does not need to be increased. Therefore, the restriction due to the installation space over the escalator system with wheel chair steps is advantageously alleviated. Also, when the already installed ordinary escalator system is to be converted into an escalator system with wheel chair steps, the already installed main frame can be utilized so that the conversion costs can be decreased.

Also, the rising stroke of the rising tread board at the upper entrance/exit of the main frame may be changed from that at the lower entrance/exit of the main frame so that the arrangement can be easily cope with the structural conditions or the like of the boarding base, resulting in an advantage that the degree of freedom in design can be increased.

What is claimed is:

1. An escalator system with wheel chair steps comprising:

a main frame having an upper end and a lower end;

a plurality of steps connected in an endless conveyor loop and capable of circulating along said main frame;

an operating mechanism disposed at a position close to said ends of said main frame;

a first wheel chair step disposed between said steps and having a connection arm capable of being displaced toward the lower end of said main frame by a shifter mechanism engageable with said operating mechanism when necessary; and a second wheel chair step disposed between said steps and having a rising tread board capable of being raised by a raising mechanism engageable with said operating mechanism when necessary and a boarding plate capable of being displaced toward the lower end of said main frame by a shifter mechanism engageable with said operating mechanism when necessary, said rising tread board, when raised, being supported by said connection arm displaced in a projected position and defining a combined and enlarged horizontal surface together with said tread board of said first wheel chair step.

2. An escalator system with wheel chair steps as claimed in claim 1 wherein, when said first wheel chair step is travelling in an initial stage of a transitional travel path and provides a difference in elevation relative to said second wheel chair step travelling in a horizontal travel path, said rising tread board raised by said raising mechanism is supported by a support arm at a location at which an enlarged horizontal tread surface is defined by said tread boards of said first and second wheel chair steps.

3. An escalator system with wheel chair steps as claimed in claim 1 wherein, when said first wheel chair step is travelling in an initial stage of a transitional travel path and provides a difference in elevation relative to said second wheel chair step travelling in a horizontal travel path and said endless conveyor loop is in the stopped state, said rising tread board raised by said raising mechanism is supported by a support arm at a location in which an enlarged horizontal surface continuous to said tread board of said first wheel chair step is defined, and wherein said first wheel chair step and said second wheel chair step travel along a constant slope travel path with their tread boards maintained in the position defining said enlarged horizontal surface.

4. A method for operating an escalator system with wheel chair steps comprising a main frame having an upper end and a lower end and a plurality of steps connected in an endless conveyor loop for circulating along said main frame, the method comprising:

raising a rising tread board of a second wheel chair step to define a combined and enlarged horizontal surface together with a first wheel chair step when said first wheel chair step and said second wheel chair step are positioned at a predetermined position at the lower end of said main frame and said first wheel chair step is positioned higher than said second wheel chair step said second wheel chair step being disposed between said steps of said endless conveyor loop and said first wheel chair step disposed adjacent to said second wheel chair step between said second wheel chair step and said upper end of said main frame; and extending a boarding plate from said second wheel chair step toward the lower end of said main frame after raising said rising tread board.

5. A method for operating an escalator system with wheel chair steps comprising a main frame having an upper end and a lower end and a plurality of steps connected in an endless conveyor loop for circulating along said main frame, the method comprising:

raising a rising tread board of a second wheel chair step to define a combined and enlarged horizontal surface together with a first wheel chair step when said first wheel chair step and said second wheel chair step are positioned at a predetermined position at the lower end of said main frame and said first wheel chair step is positioned higher than said second wheel chair step, said second wheel chair step being disposed between said steps of said endless conveyor loop and said first wheel chair step being disposed adjacent to said second wheel chair step between said second wheel chair step and said upper end of said main frame; and connecting said first wheel chair step to said second wheel chair step with a connection arm of said first wheel chair step after raising said rising tread board.

6. A method for operating an escalator system with wheel chair steps comprising a main frame having an upper end and a lower end and a plurality of steps connected in an endless conveyor loop for circulating along said main frame, the method comprising:

raising a rising tread board of a second wheel chair step to define a combined and enlarged horizontal surface together with a first wheel chair step when said first wheel chair step and said second wheel chair step are positioned at a predetermined position at the lower end of said main frame and said first wheel chair step is positioned higher than said second wheel chair step, said second wheel chair step being disposed between said steps of said endless conveyor loop and said first wheel chair step being disposed adjacent to said second wheel chair step between said second wheel chair step and said upper end of said main frame; and moving said first wheel chair step and said second wheel chair step along a constant slope travel path with their tread boards maintained in the position defining said enlarged horizontal surface.

7. A method for operating an escalator system with wheel chair steps as claimed in claim 4, further comprising:

extending said boarding plate to a position projected from said second wheel chair step for allowing a wheel chair user to board the escalator system;

retracting said boarding plate; and extending a wheel stopper on said second wheel chair step to a position projected from a tread of said second wheel chair step towards the lower end of said main frame.

8. A method for operating an escalator system with wheel chair steps as claimed in claim 4, further comprising:

moving a tilting tread board of a tilting wheel chair step to a tilted position upon conveying a wheel chair, said tilted step being connected in said endless conveyor loop and disposed adjacent to said first wheel chair step between said first wheel chair step and said upper end of said main frame.

9. A method for operating an escalator system with wheel chair steps as claimed in claim 4, further comprising:

stopping said first wheel chair step and said second wheel chair step at a predetermined position at the lower end of said main frame; and operating an operating mechanism in a rising mode to raise said rising tread board of said second wheel chair step.

10. A method for operating an escalator system with wheel chair steps as claimed in claim 4, further comprising:

stopping said first wheel chair step and said second wheel chair step at a predetermined position at the lower end of said main frame; and operating an operating mechanism in a driving mode to raise said rising tread board of said second wheel chair step.

11. A method for operating an escalator system with wheel chair steps as claimed in claim 4, further comprising:

stopping said first wheel chair step and said second wheel chair step at a predetermined position at the lower end of said main frame; and operating an operating mechanism into engagement with said rising tread board of said second wheel chair step.

12. A method for operating an escalator system with wheel chair steps as claimed in claim 8, further comprising:

moving said tilting tread board of said tilting wheel chair step to a tilted position when said first and said second wheel chair steps are stopped at a predetermined position at the upper end of said main frame.

13. A method for operating an escalator system with wheel chair steps as claimed in claim 8, further comprising:

moving said tilting wheel chair step to a position below a comb plate of the upper end of said main frame when said first and said second wheel chair steps are stopped at a predetermined position at the upper end of said main frame.

14. A method for operating an escalator system with wheel chair steps as claimed in claim 5, wherein an amount of raised displacement of said rising tread board, at a lower horizontal run of said main frame when said rising tread board of said second wheel chair step is raised to define said enlarged horizontal surface together with said first wheel chair step, is different from an amount of the raised displacement of said rising tread board at an upper horizontal run of said main frame.

* * * * *

UNITED STATES PATENT AND TRADEMARK OFFICE

CERTIFICATE OF CORRECTION

PATENT NO. : 5,992,605

DATED : November 30, 1999

INVENTOR(S) : Yasumasa Haruta

It is certified that error appears in the above-identified patent and that said Letters Patent is hereby corrected as shown below:

In claim 12, column 18, line 9, change "upper" to --lower--.

Signed and Sealed this

Ninth Day of January, 2001

*Attest:*

Q. TODD DICKINSON

*Attesting Officer*

*Commissioner of Patents and Trademarks*